United States Patent [19]

Conte

[11] Patent Number: 4,745,667

[45] Date of Patent: May 24, 1988

[54] CLOSURE DEVICE AND BUCKLE

[75] Inventor: Robert R. Conte, Cranston, R.I.

[73] Assignee: Victoria Creations, Inc., Warwick, R.I.

[21] Appl. No.: 76,545

[22] Filed: Jul. 20, 1987

[51] Int. Cl.[4] ..... A44B 17/00

[52] U.S. Cl. ..... 24/615; 24/116 A; 24/616

[58] Field of Search ..... 24/615, 616, 617, 116 A, 24/71 J, 265 WS, 194, 196, 323

[56] References Cited

U.S. PATENT DOCUMENTS

| | | | |
|---|---|---|---|
| 248,641 | 10/1881 | Etzensperger | 24/616 |
| 251,645 | 12/1881 | Scherer | 24/616 |
| 856,606 | 6/1907 | Scanlon | 24/616 |
| 1,477,597 | 12/1923 | Schneider | 24/616 |
| 1,957,141 | 5/1934 | Jordan | 24/616 |
| 2,986,792 | 6/1961 | Wyatt | 24/616 |
| 3,656,211 | 4/1972 | Turner et al. | 24/194 |
| 3,798,711 | 3/1974 | Cousins | 24/323 |
| 3,844,000 | 10/1974 | Hedu | 24/615 |
| 3,967,351 | 7/1976 | Rosenberg et al. | 24/616 |
| 4,520,537 | 6/1985 | Valikov | 24/116 A |

FOREIGN PATENT DOCUMENTS

| | | | |
|---|---|---|---|
| 1000637 | 2/1952 | France | 24/615 |

*Primary Examiner*—Victor N. Sakran
*Attorney, Agent, or Firm*—Salter & Michaelson

[57] ABSTRACT

A closure device includes a female member which is open at the front end thereof and a male member which is receivable through the open front end of the female member for releasably securing it in a locked position in the female member. The female member includes a top wall having a substantially rectangular aperture therein, and the male member includes a resiliently depressible button portion which is of substantially rectangular configuration and is receivable in the aperture in the female member for securing the male member in the locked position. The female member further includes a pair of spaced alignment tabs which extend inwardly into the open front end thereof for guiding the button portion of the male member into the aperture when the male member is inserted into the female member. The closure device is operable in combination with a pair of plate-like buckle members for securing the buckle members together to form a buckle.

10 Claims, 2 Drawing Sheets

CLOSURE DEVICE AND BUCKLE

BACKGROUND AND SUMMARY OF THE INVENTION

The instant invention relates to the jewelry art and more particularly to an improved jewelry closure device and to a buckle incorporating the closure device.

A wide variety of different types of jewelry closure devices have been heretofore available to meet the needs of various specific jewelry applications wherein it is necessary to releasably secure two separate elements or two opposite end portions of the same element together. For example, a number of jewelry closure devices have been heretofore available for securing various link elements of chains and the like together, as well as for securing the opposite end portions of various chains, necklaces, and bracelets together. In most cases, the heretofore available jewelry closure devices have comprised first and second closure elements which are securable to elements of various jewelry items, such as the opposite end portions thereof, and which are detachably securable together in locked positions for securing the elements or end portions to which they are attached together. It has been found that in most cases, in order to be effective, the first and second closure elements of a jewelry closure device of this general type must be readily and easily securable together in a locked position and also readily and easily releasable to a separated or unlocked position when desired. It has been further found that in order to be effective, a jewelry closure device of this general type must be operative for positively securing the first and second closure elements thereof together so that they are not prone to being inadvertently released or disconnected when they are in the locked position. It has also been found that in order for a jewelry closure device of this general type to be practical for a wide range of applications, it must be adapted for relatively inexpensive sheet-metal constructions.

One specific type of heretofore available jewelry closure device which has been found to be generally effective comprises male and female elements which are securable to different elements of jewelry items or to opposite end portions of the same item and which are releasably securable in a locked position wherein the male element is received in the female element. Devices of this general type which represent the closest prior art to the subject invention of which the applicant is aware are disclosed in the U.S. Pat. Nos. 248,641 to Etzensperger; 251,645 to Scherer; 468,175 to Adams; 856,606 to Scanlon; 320,464 to Cousins; and 3,798,711 to Cousins. However, many of the closure devices disclosed in these references are not adapted for inexpensive sheet-metal constructions, and many of them have been found to be prone to inadvertent disengagement. In any event, the devices disclosed in these references have not had the specific features of the closure device of the instant invention which make it simply and easily securable in a locked position and easily releasable to an unlocked position, and hence they are believed to be of only general interest with respect to the subject invention.

The instant invention provides an improved closure device which is adapted for relatively inexpensive constructions and which can be effectively utilized for releasably securing two jewelry items or the opposite end portions of the same jewelry item together. More specifically, the closure device of the instant invention comprises a female member which is open at the front thereof and includes a pair of spaced sidewalls, a bottom wall and a top wall having a substantially rectangular aperture therein. The closure device further comprises a male member including a bottom plate portion which is dimensioned to be slidably received on the bottom wall of the female member, a nose portion which extends integrally upwardly from the front end of the bottom plate portion and then rearwardly in upwardly spaced relation to the bottom plate portion, and a resiliently depressible button portion which extends upwardly and then rearwardly from the nose portion. The button portion comprises a front wall portion which extends upwardly from the nose portion, a top plate portion which extends rearwardly from the front wall portion in further upwardly spaced relation to the bottom plate portion, and a rear wall portion which extends downwardly toward the bottom plate portion from the top plate portion. The male and female members are preferably constructed from a suitable sheet metal, and they are adapted so that the male member is receivable in the female member by inserting the front end of the male member into the open end of the female member and then advancing the male member further inwardly into the female member until the male member is received in a locked position in the female member. More specifically, the male and female members are constructed so that the male member is releasably securable in a locked position in the female member wherein the bottom plate portion of the male member is received on the bottom wall, and the button portion of the male member is received in the aperture in the top wall of the female member so that the rear wall portion of the button portion engages the front edge of the aperture to prevent the male member from being inadvertently removed from the female member. The button portion preferably further includes a terminal portion which extends rearwardly from the rear wall portion thereof to prevent the rear wall portion of the button portion from passing entirely through the aperture, and the button portion is preferably formed so that the front wall portion thereof merges with the top plate portion in a gradually rounded cam surface to enable the male member to be more easily inserted into the female member. The top plate portion of the button portion is preferably of substantially rectangular configuration and of slightly smaller dimension than the aperture in the top wall of the female member. The open end of the female member is preferably of substantially rectangular configuration, and the bottom slide plate portion of the male member preferably has a width which is only slightly less than the width of the bottom wall. Further, the nose portion and button portion of the male member are preferably constructed so that they have substantially the same width, and they are preferably both narrower than the bottom plate portion. The female member preferably further includes a pair of spaced alignment tabs which extend inwardly and together along the top wall portion from opposite sides of the open end of the female member. The alignment tabs are preferably positioned for receiving the button portion of the male member therebetween and for guiding the button portion into the aperture when the male member is inserted into the female member. Further, the female member is preferably constructed so that the height thereof is gradually reduced from the open front end of the female member to the rear end thereof. Accordingly, when the male member is inserted into the female member, the button portion projects further upwardly through the rear portion of the aperture in the female member to enable the male member to be more easily released from the locked position. Still further, the closure device is preferably constructed so that when the male member is received in a locked position in the female member, the button portion defines the uppermost portion of the male member and so that the male member is releasable by manually depressing the button portion to disengage the rear wall portion of the button portion from the front edge of the aperture but so that the button portion is not prone to inadvertent disengagement from the aperture.

It has been found that the structural features of the closure device of the subject invention make it highly practical and effective for a wide variety of applications. Specifically, it has been found that it is readily adapted for a variety of relatively inexpensive sheet-metal constructions. Further, the it has been found that specific dimensions and configurations of the male and female members make the male member readily and easily receivable in the female member. In particular, it has been found that the alignment tabs effectively guide the male member as it is inserted into the female member, that the bottom plate portion of the male member also effectively guides the male member as it is inserted into the female member, and that the rounded forward portion of the button portion causes the button portion to be easily and effectively cammed downwardly as the male member is inserted into the female member. It has also been found that the specific structural features of the male member and the female member enable the male member to be secured in a locked position in the female member wherein it is easily releasable therefrom although not readily inadvertently releasable therefrom. Specifically, the front wall of the button portion positively engages the forward edge of the aperture to retain the male member in the female member. Further, since the button portion defines the uppermost portion of the male member when the male member is received in the locked position, the male member inherently does not include elements which extend further upwardly above the button portion and which could therefore cause it to be inadvertently disengaged from the female member. Still further, it has been found that the tapered configuration of the female member causes the button portion to project upwardly above the female member by an increased amount in the rear portion of the aperture in the female member to enable the male member to be more easily released from the female member.

The instant invention also provides an effective buckle construction comprising the inventive closure device. Specifically, the buckle construction of the instant invention comprises a first buckle member having front and rear sides and having a first mating edge on one peripheral edge portion thereof and a recess in the rear side thereof, and a second buckle member having front and rear sides and having a second mating edge on one peripheral edge portion thereof and a recess in the rear side thereof. The first and second buckle members are formed so that they are receivable in mating relation with the mating edges thereof received in mating engagement, and a female closure member of the subject invention is secured in the recess on the rear side of the first closure member so that the open front end of the first closure member faces outwardly from the first mating edge. A male closure member of the subject invention is secured to the rear side of the second buckle member in the recess therein so that it projects outwardly from the second mating edge and so that it is receivable in the female closure member for securing the buckle members in assembled relation with the mating edges thereof received in mating engagment.

It has been found that the buckle of the instant invention also has specific advantages over other types of buckle constructions. In particular, it has been found that because the female and male closure members of the buckle are disposed in the recesses in the first and second buckle members, respectively, and that because the closure members are formed without rearwardly extending projections or the like thereon, the buckle can be worn against the skin without causing irritations or on clothing without causing damage thereto.

Accordingly, it is a primary object of the instant invention to provide an improved jewelry closure device.

Another object of the instant invention is to provide a jewelry closure device which is easily securable in a locked position and easily releasable to an unlocked position, but not prone to inadvertent disengagement to said unlocked position.

A still further object of the instant invention is to provide an effective jewelry closure device which is adapted for relatively inexpensive constructions.

Still another object of the instant invention is to provide an effective buckle which incorporates the closure device of the instant invention.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
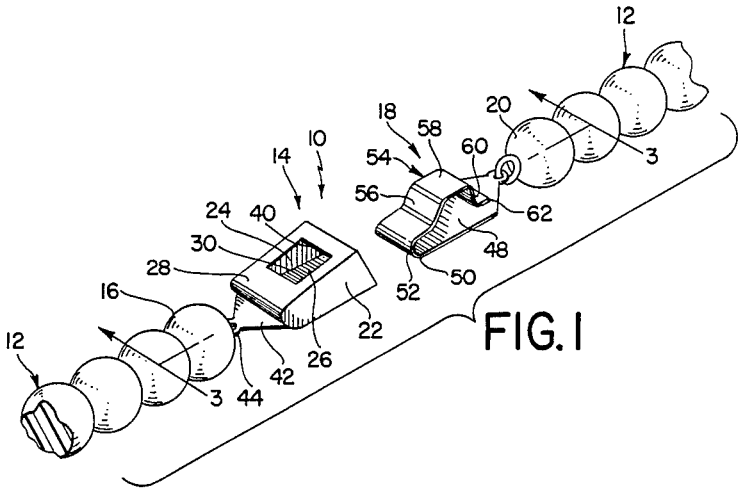
FIG. 1 is a perspective view of the closure device of the instant invention as it is utilized for releasably connecting the opposite end portions of a necklace.
Figure 2:
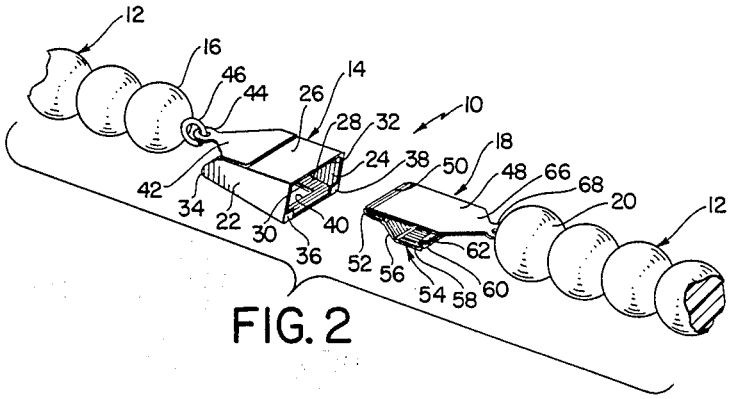
FIG. 2 is a bottom perspective view thereof.
Figure 3:
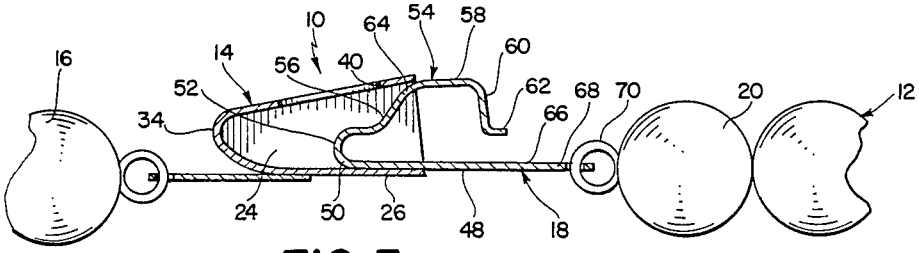
FIG. 3 is an enlarged side sectional view thereof illustrating the insertion of the male member into the female member.
Figure 4:
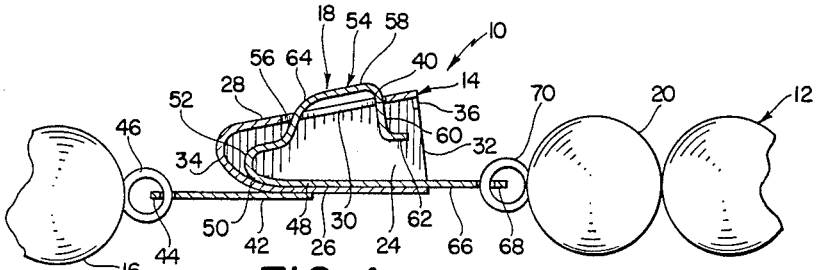
FIG. 4 is an enlarged side sectional view thereof with the male member in a locked position in the female member.
Figure 5:
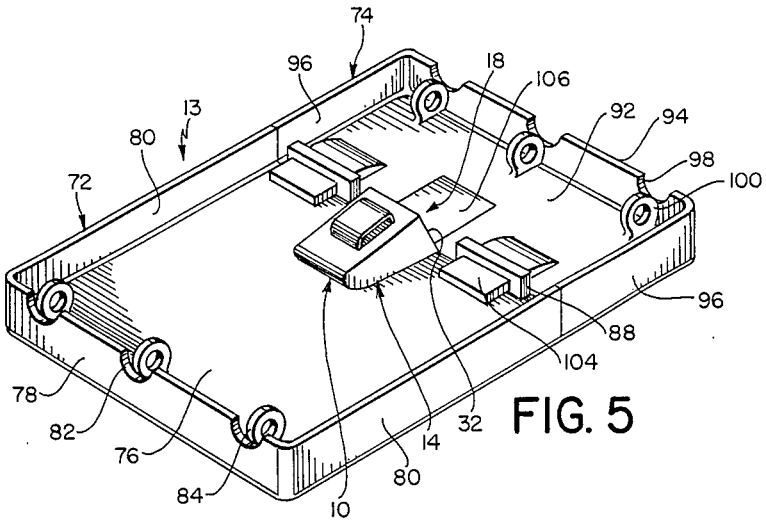
FIG. 5 is a rear perspective view of the buckle of the instant invention in the assembled position.
Figure 6:
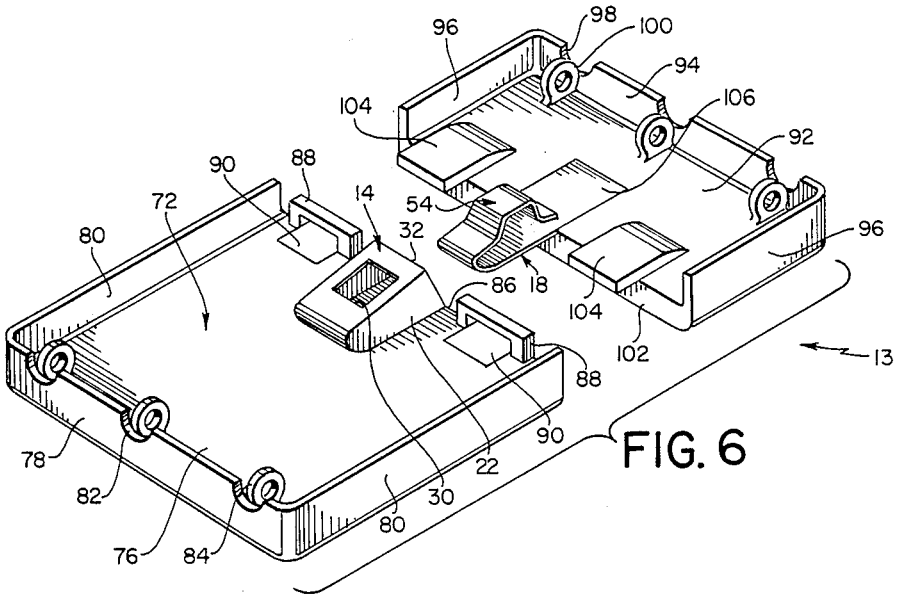
FIG. 6 is a similar view with the buckle in the disassembled position.
Figure 7:
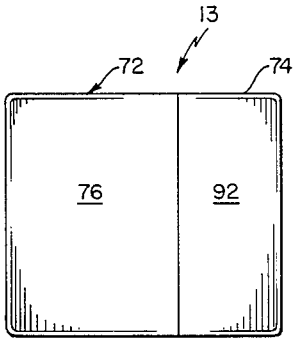
FIG. 7 is a front elevational view of the buckle in the assembled position.

Referring now to the drawing, the closure device of the instant invention is generally indicated at 10 in FIGS. 1 through 4 wherein it is illustrated in combination with a necklace generally indicated at 12, and the buckle of the instant invention is illustrated in FIGS. 5–7 and generally indicated at 13.

The closure device 10 comprises a female member generally indicated at 14 which is secured to a first end portion 16 of the necklace 12, and a male member 18 which is secured to a second end portion 20 of the necklace 12, and it is constructed so that the male member 18 is releasably receivable in a locked position in the female member 14 for detachably interconnecting the first end portion 16 of the necklace 12 to the second end portion 20 thereof.

The female member 14 is preferably integrally formed from a sheet metal, and it comprises an open box-like structure including a pair of spaced sidewalls 22 and 24, a bottom wall 26, and a top wall 28 having a substantially rectangular aperture 30 therein. The female member 14 has a substantially open front end 32 of substantially rectangular configuration and a substantially closed rear end 34, and it includes a pair of alignment tabs 36 and 38 which extend inwardly and together from the side walls 22 and 24, respectively, along the adjacent edge of the top wall 20 at the open front end 32. In this regard, the alignment tabs 36 and 38 are preferably formed so that the inner edges thereof, i.e., the edges thereof which extend downwardly from the top wall 28 are substantially aligned with the side edges of the aperture 30. The aperture 30 is preferably of rectangular configuration, and it preferably includes a substantially straight front edge 40 which is substantially parallel to the front edge of the top wall 28. The female member 14 is preferably formed so that the vertical height thereof is gradually reduced in the rearward extent of the female member 14 and so that the bottom wall 26 curls upwardly toward the top wall 28 adjacent the rear end 34 of the female member 14 to impart a rounded configuration to the rear end 34. A tab 42 is soldered to the bottom side of the bottom wall 26, the tab 42 having an eyelet portion 44 which is securable to a ring 46 on the end portion 16 of the necklace 12 to secure the female member 14 thereto.

The male member 18 is preferably also integrally formed from a suitable sheet material, and it comprises a bottom slide plate portion 48 having a forward end 50, a nose portion 52 which extends upwardly from the forward end 50 and then rearwardly in upwardly spaced relation to the plate portion 48, and a button portion generally indicated at 54 which extends upwardly and rearwardly from the nose portion 52. The button portion 54 comprises a front wall portion 56 which extends upwardly from the nose portion 52, a top plate portion 58 which extends rearwardly in further upwardly spaced relation to the bottom plate portion 48, a rear wall portion 60 which extends downwardly toward the bottom plate portion 48 from the top plate portion 58, and a terminal portion 62 which extends further rearwardly from the rear wall portion 60. The button portion 54 is preferably formed so that the transverse front wall portion 56 merges with the top plate portion 58 in a gradually rounded area which defines a rounded camming surface 64 on the button portion 54, and the top plate portion 58 preferably has a substantially rectangular configuration and an overall dimension which is slightly less than that of the aperture 30. The bottom plate portion 48 preferably has a width which is only slightly less than the width of the bottom wall 26 so that it is slidably receivable on the bottom wall 26 but nevertheless guided in its rearward movement thereover by the sidewalls 22 and 24. The nose portion 52 and the button portion 54 are preferably both of substantially the same width but narrower than the bottom plate portion 48 to enable the button portion 54 to pass between the alignment tabs 36 and 38 when the male member 16 is inserted into the female member 14. The bottom plate portion 48 of the male member 18 is preferably integrally formed with a rearwardly extending tab 66 having an eyelet 68 therein which is secured to a ring 70 on the second end portion 20 of the necklace 12 for securing the male member 18 thereto.

For use and operation of the clasp 10 to releasably interconnect the first and second end portions 16 and 20, respectively, the nose portion 52 of the male member 18 is inserted into the open front end 32 of the female member 14 so that the bottom plate portion 48 is aligned with the bottom wall 26, and the button portion 54 is aligned with the spacing between the alignment tabs 36 and 38. The male member 18 is then further advanced into the female member 14 so that the camming surface 64 engages the top wall 28 at the open end 32 to resiliently depress the button portion 54 downwardly to enable it to pass into the female member 14. Once the male member 18 has been inserted into the female member 14 to a position wherein the button portion 54 is aligned with the aperture 30, the button portion 54 resiliently snaps upwardly to a locked position wherein the transverse rear wall 60 thereof engages the front edge 40 of the aperture 30 to prevent the male member 18 from being removed from the female member 14. When the male member 18 is in this position, the nose portion 52 at the forward end of the male member 18 engages the curved end portion of the bottom wall 26 of the female member 14 to further position the male member 18 in the female member 14. Further, because the height of the female member 14 is gradually reduced in the rearward extent of the female member 14, the button portion 54 projects upwardly by an increased amount in the rear portion of the aperture 30 to enable the button portion 54 to be easily depressed to disengage it from the forward edge 40. However, because the forward edge 40 engages the rear wall portion 60 of the button portion 54 at an intermediate point in the rear wall portion 60 which is downwardly spaced from the top plate position 58, the button portion 54 cannot inadvertently slip downwardly and out of the aperture 30. Further, because the terminal portion 62 extends beyond the rear wall 60, the button portion 54 is prevented from inadvertently moving upwardly to a position wherein the entire rear wall portion 60 is disposed above the top wall 28 of the female member 14. Still further, because the male member 18 and the female member 14 are constructed so that when the male member 18 is received in a locked position in the female member 14, the button portion 54 defines the uppermost portion of the male member 18, the male member 18 does not include other elements which extend further upwardly and which could be inadvertently depressed to disengage the button portion 54.

Referring now to FIGS. 5–7, the buckle 13 is illustrated. The buckle 13 comprises a first plate-like buckle member generally indicated at 72, a second plate-like buckle member generally indicated at 74, a female closure member 14 and a male closure member 18. The female closure member 14 is secured on the rear side of the first buckle member 72, and the male closure member 18 is secured to the rear side of the second buckle member 74, so that the closure members 14 and 18 are receivable in engagement in the manner hereinabove set forth for releasably securing the first and second buckle members 72 and 74, respectively, in assembled relation as illustrated in FIGS. 5 and 7.

The first buckle member 72 is preferably cast from a suitable metal in a substantially rectangular configuration, and it includes a front wall 76, an end wall 78 and a pair of spaced side walls 80, all of which extend rearwardly from the front wall 76 to form a recessed area on the rear side of the buckle member 72. A plurality of notches 82 are formed in the end wall 78, and a plurality of eyelets 84 are secured to the rear side of the front wall 76 so that they are aligned with the notches 82. The end of the buckle member 72 which is opposite from the end wall 78 is defined by a substantially straight and flat mating edge 86. A pair of spaced loops 88 are formed on the rear side of the front wall 76 adjacent the mating edge 86, and flat surfaces 90 are formed on the rear side of the front wall 76 beneath the loops 88.

The second buckle member 74 includes a front wall 92, an end wall 94 and a pair of spaced sidewalls 96 which extend rearwardly from the front wall 92 to define a recessed area in the rear side of the buckle member 74. A plurality of notches 98 are formed in the end wall 94, and a plurality of eyelets 100 are formed on the rear wall 92 so that they are aligned with the notches 98. A substantially flat, straight, mating edge 102 is formed on the opposite extremity of the buckle member 74 from the end wall 94, and a pair of spaced tongues 104 are formed on the bottom wall 92 so that they project beyond the mating edge 102 and are receivable in the loops 88 on the first buckle member 72. The second buckle member 74 is adapted so that it is receivable in assembled relation with the first buckle member 72 with the mating edge 102 received in mating engagement with the mating edge 86 and with the tongues 104 received in the loops 88.

The female closure member 14 is substantially the same as the female closure member 14 hereinabove described, and it is secured on the rear side of the front wall 76 of the first buckle member 72 so that the open front end 32 of the closure member 14 faces outwardly from the mating edge 86. The closure member 14 is preferably soldered to the rear wall 76 to permanently attach it to the buckle member 72.

The male closure member 18 is also substantially identical to the closure member 18 hereinabove set forth. However, in this instance, the closure member 18 is integrally formed with an enlarged rearwardly extending tab 106 which is soldered to the rear side of the front wall 92 of the buckle member 74 to secure the closure member 18 thereto. The closure member 18 is secured to the buckle member 74 so that it projects from the mating edge 102 thereof and is receivable in engagement in the female closure member 14 when the buckle members 74 and 72 are received in assembled relation.

For use and operation of the buckle 13, opposite ends of a necklace, chain, or the like are secured to the buckle members 72 and 74 with the eyelets 84 and 100. The buckle members 72 and 74 may then be assembled to the position illustrated in FIGS. 5 and 7 for securing the necklace, chain or the like on a wearer. In this regard, since the top plate portion 58 defines the rearmost portion of the closure member 10 on the buckle 13 and since the closure member 10 does not include rearwardly extending sharp projections or the like, the buckle 13 can be comfortably worn against the skin without causing irritations or it can be worn over clothing without causing damage thereto. Further, since the closure device 10 is recessed in the rear portions of the buckle 13, the chances of causing skin irritations or clothing damage are even further minimized. Still further, the tongue members 104 and the loops 88 effectively cooperate with the closure device 10 for maintaining the buckle members 72 and 74 in substantially planar relation when the mating edges 86 and 102 are received in mating relation.

It is seen, therefore, that the instant invention provides an effective jewelry closure device which is adapted for relatively inexpensive constructions and which is simply and easily operable for positively securing two jewelry elements or two opposite end portions of a single jewelry element together. Specifically, both the male member 18 and the female member 14 can be effectively manufactured from relatively inexpensive sheet metals. Further, the specific structural features of the male member 18 and the female member 14 enable the male member 18 to be easily received in an aligned position relative to the female member 14 and thereafter passed into a locked position wherein the forward egde 40 of the aperture 30 positively engages the rear wall 60 of the button portion 54. The button portion 54 is, however, easily depressible to release the male member 18 from the female member 14 when desired. Still further, the closure device 10 is particularly effective when combined with the buckle members 72 and 74 to form the buckle 13 as hereinabove set forth. Hence, it is seen that the closure device of the instant invention and the buckle device of the instant invention represent significant advancements in the jewelry art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A closure device comprising: a female member having front and rear ends and comprising spaced top and bottom walls and a pair of spaced sidewalls extending therebetween, said female member being open at the front end thereof and including a substantially rectangular aperture having a front edge in said top wall; and a male member having front and rear ends and comprising a bottom plate portion dimensioned to be slidably received on said bottom wall, a nose portion which extends upwardly from said bottom plate portion to define the front end of said male member and then rearwardly in upwardly spaced relation to said bottom plate portion and a resiliently depressible button portion comprising a front wall portion which extends upwardly from said nose portion, a top plate portion which extends rearwardly from said front wall portion in further upwardly spaced relation to said bottom plate portion, said top plate portion being substantially disposed in a plane which is spaced upwardly from the rearwardly extending portion of said nose portion, and a rear wall portion which extends downwardly towards said bottom plate portion from said top plate portion, said male member being receivable in said female member by inserting the front end of said male member through the open front end of said female member and being releasably securable in a locked position therein wherein said bottom plate portion is received on said bottom wall and said button portion is received in said aperture with the top plate portion above the level of the adjacent portion of said top wall and with the rear wall portion of said button portion engaging the front edge of said aperture to prevent the inadvertent removal of said male member from said female member, said female member further comprising a pair of spaced alignment tabs in the open end thereof, said tabs extending inwardly and together a distance along said top wall portion from opposite sides of said female member and being positioned for receiving said button portion therebetween for guiding said button portion into said aperture when said male member is inserted into said female member.

2. In the closure device of claim 1, said button portion further comprising a terminal portion extending rearwardly from said rear wall portion to prevent said rear wall portion from passing entirely through said aperture.

3. In the closure device of claim 2, the terminal portion of said button portion terminating in inwardly spaced relation to the open front end of said female member when said male member is in said locked position.

4. In the closure device of claim 1, said male member being integrally formed said button portion front wall portion merging with said top plate portion in a gradually rounded cam surface.

5. In the closure device of claim 1, said top plate portion being of substantially rectangular configuration and of slightly smaller dimension than said aperture.

6. In the closure device of claim 1, the height of said female member being gradually reduced from the front end of said female member to the rear end thereof to position said button portion so that it extends further upwardly in the rear portion of said aperture when said male member is received in said locked position.

7. In the closure device of claim 1, said female member and said male member each being integrally formed from sheet metal.

8. In the closure device of claim 1, said button portion defining the uppermost portion of said male member.

9. A buckle construction comprising:

a. a first plate-like buckle member having front and rear sides and having a first mating edge on one peripheral edge portion thereof, said first buckle member having a recess in the rear side thereof which extends to said first mating edge;

b. a second plate-like buckle member having front and rear sides and having a second mating edge on one peripheral edge portion thereof which is receivable in mating engagement with said first mating edge, said second buckle member being receivable in an assembled relation with said first buckle member wherein said first mating edge is received in mating engagement with said second mating edge;

c. a female closure member having front and rear ends and comprising spaced top and bottom walls, and a pair of spaced sidewalls extending therebetween, said female closure member being open at the front end thereof and including a substantially rectangular aperture having a front edge in said top wall, the bottom wall of said female closure member being secured to the rear side of said first buckle member so that said female closure member is disposed in the recess therein and so that the open front end of said female closure member faces outwardly from said first mating edge; and d. a male closure member having front and rear ends and comprising a bottom plate portion dimensioned to be slidably received on said bottom wall, a nose portion which extends upwardly from said bottom plate portion to define the front end of said male member and then rearwardly in upwardly spaced relation to said bottom plate portion and a resiliently depressible button portion comprising a front wall portion which extends upwardly from said nose portion, a top plate portion which extends rearwardly from said front wall portion in further upwardly spaced relation to said bottom plate portion, and a rear wall portion which extends downwardly towards said bottom plate portion from said top plate portion, and a rear tab which extends rearwardly from said bottom plate portion, said tab being secured to the rear side of said second buckle member in said recess therein so that said male closure member projects beyond said second mating edge, said male closure member being receivable in said female closure member for securing said buckle members in said assembled relation by inserting the front end of said male closure member through the open front end of said female closure member, said male closure member being releasably securable in a locked position in said female closure member wherein said bottom plate portion is received on said bottom wall and said button portion is received in said aperture with the rear wall portion of said button portion engaging the front edge of said aperture to prevent the inadvertent removal of said male closure member from said female closure member.

10. The buckle construction of claim 9 further comprising a tongue on one of said first or second buckle members extending beyond the mating edge thereof and a loop on the other of said first or second buckle members for receiving said tongue therein to maintain said buckle members in aligned relation when said male closure member is received in said female closure member.

* * * * *